US006334231B2

(12) United States Patent
Safieh

(10) Patent No.: US 6,334,231 B2
(45) Date of Patent: Jan. 1, 2002

(54) INFANT TOOTHBRUSH

(76) Inventor: Eric Safieh, 120 Promenade Circle, Apt. #1407, Thornhill, Ontario (CA), L4J 7W9

( * ) Notice: Subject to any disclaimer, the term of this patent is extended or adjusted under 35 U.S.C. 154(b) by 0 days.

(21) Appl. No.: 09/803,056

(22) Filed: Mar. 12, 2001

Related U.S. Application Data

(63) Continuation of application No. 09/355,999, filed on Aug. 12, 1999, now abandoned.

(30) Foreign Application Priority Data

Feb. 13, 1997 (CA) ..... PCT/CA97/00094

(51) Int. Cl.[7] ..... A46B 5/00; A46B 9/04; A61J 9/00

(52) U.S. Cl. ..... 15/167.1; 215/11.1; 15/143.1

(58) Field of Search ..... 215/11.1; 15/167.1, 15/143.1; D24/193, 194, 195, 196

(56) References Cited

U.S. PATENT DOCUMENTS

| | | | |
|---|---|---|---|
| 361,806 | A | 4/1887 | Ballard |
| 1,645,965 | A | 10/1927 | Neumerkel |
| 1,813,361 | A | 7/1931 | Priest |
| 1,848,543 | A | 3/1932 | Priest |
| 2,206,727 | A | 7/1940 | Lasater |
| 2,701,381 | A | 2/1955 | Lodewick et al. |
| 3,753,266 | A | 8/1973 | Ceniceros |
| 4,621,387 | A | 11/1986 | Noser |
| 5,571,140 | A | 11/1996 | Gura-Emerling |
| D383,307 | S | 9/1997 | Klein et al. |
| 6,015,328 | A | 1/2000 | Glasser |
| D435,346 | S | 12/2000 | Safieh |

FOREIGN PATENT DOCUMENTS

| | | |
|---|---|---|
| GB | 2067069 | 7/1981 |
| WO | WO 94/24916 | 11/1994 |

*Primary Examiner*—Randall E. Chin
(74) *Attorney, Agent, or Firm*—Merek & Voorhees

(57) ABSTRACT

An infant toothbrush is described that comprises a generally cylindrical handle member and a brush head. The handle member is in the form of a baby bottle having an upper end and lower end. The brush head is releaseably securable to the upper end of the baby bottle. The brush head is comprised of a generally conical central body having a lower generally cylindrical base and an upper reduced diameter neck portion ending in a generally rounded tip. The rounded tip has a plurality of protrusions positioned thereon. The cylindrical base of the brush head is releaseably securable to the baby bottle.

13 Claims, 5 Drawing Sheets

INFANT TOOTHBRUSH

This application is a continuation based on a claim for priority made under 35 USC 120 based on U.S. patent application Ser. No. 09/355,999 filed on Aug. 12, 1999, now abandoned, and under 35 USC 119 based on PCT/CA97/00094.

FIELD OF THE INVENTION

This invention relates to oral hygiene devices, and in particular tooth cleaning and gum stimulating devices for use on the teeth and gums of infants and small children.

BACKGROUND OF THE INVENTION

The benefits of proper oral hygiene upon the health of an individual's teeth and gums is well known and documented. Over recent years, it has been shown that good oral hygiene on the part of infants, babies and small children can be advantageous from the perspective of preventing tooth decay and maintaining healthy gums. The development of good oral hygiene practices and techniques for young children also tends to develop oral hygiene habits that are carried with the child throughout his or her lifetime.

Prior to the emergence of teeth in an infant, gently rubbing, brushing or scrubbing the infant's gums will serve as a means to help dislodge bacteria and help to maintain the health of the gums. Gently rubbing a child's gums will also provide a soothing affect to gums that may become inflamed when the child is teething. When teeth eventually emerge from the gums into the oral cavity the enamel surface of the teeth will benefit from brushing through the removal of plaque and other debris that may result in acidic formations upon the teeth, and eventually tooth decay.

Traditionally the teeth and gums of infants and very young children (typically under the age of 1) are cleaned through gently wiping with gauze or a wash cloth. Usually after approximately 6 months of age, and a number of teeth begin emerging from the child's gums, brushing with a standard toothbrush is often introduced. Typical toothbrushes designed for small children are generally identical to commonly used adult toothbrushes, but smaller in size. Since infants and small children are physically incapable of effectively brushing their own teeth and gums, and as the placement of the toothbrush within a child's mouth presents a potential choking hazard, most parents initiate an oral hygiene program for their children by way of physically assisting with the brushing of the teeth. Unfortunately infants and small children are often not co-operative making it very difficult, if not in some cases impossible, to adequately clean the child's teeth.

As children become older they naturally attempt to become more independent and often wish to conduct standard routine tasks themselves. For example a two year old may refuse to allow a parent to brush his or her teeth and insist upon brushing them himself. Unfortunately, the manual dexterity exhibited by most small children is insufficient to allow an adequate brushing of the teeth and gums. The problem is exasperated by the fact that currently available infant toothbrushes are generally formed with relatively thin handles that are difficult for a small child to grasp. The development of motor function within the hands of a child often lags behind the development of other physical abilities. It is quite often not until the age of three or four that a child has developed sufficient hand function to enable him or her to grasp small thin cylindrical objects (such as a pencil or crayon) and perform desired functions with them. The long, cylindrical, thin handles of infant toothbrushes fall into the same category making them difficult for many small children to grasp properly and use effectively.

SUMMARY OF THE INVENTION

The invention therefore provides a baby or infant toothbrush that is simple and easy to use by small children, that is relatively inexpensive and easily constructed, and that is safe and may be used by infants and children without constant parental supervision or assistance.

Accordingly, in one of its aspects the invention provides an infant toothbrush comprising a generally cylindrical handle member, said handle member comprising a baby bottle having an upper end and lower end; and, a brush head releaseably securable to said upper end of said baby bottle, said brush head comprised of a generally conical central body having a lower generally cylindrical base and an upper reduced diameter neck portion ending in a generally rounded tip, said cylindrical base releaseably securable to said baby bottle, said rounded tip having a plurality of protrusions positioned thereon.

In a further aspect the invention provides an infant toothbrush comprising a handle and a brush head releaseably securable thereto, said handle comprising a baby bottle having a cap threadably receivable upon one end thereof, said cap having a centrally located hole therethrough, said brush head comprised of a generally conical central body having a lower relatively thin radially outward extending flange and an upper neck portion ending in a generally rounded tip having a plurality of protrusions positioned thereon, said radial flange receivable between said baby bottle cap and said baby bottle with said conical central body extending through said hole in said cap when said cap is threadably received upon said bottle.

In yet a further embodiment the invention provides an infant toothbrush comprising a generally cylindrical handle having opposed first and second ends and a brush head releaseably securable to said first end of said handle, said handle comprising a baby bottle having threads about its exterior surface at said first end, said brush head comprising a generally conical central body having a lower generally hollow cylindrical base portion and an upper neck portion ending in a generally rounded tip having a plurality of protrusions positioned thereon, said cylindrical base portion of said brush head including internal threads engagable with said threads on said exterior surface of said first end of said baby bottle so as to releaseably secure said brush head to said baby bottle.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
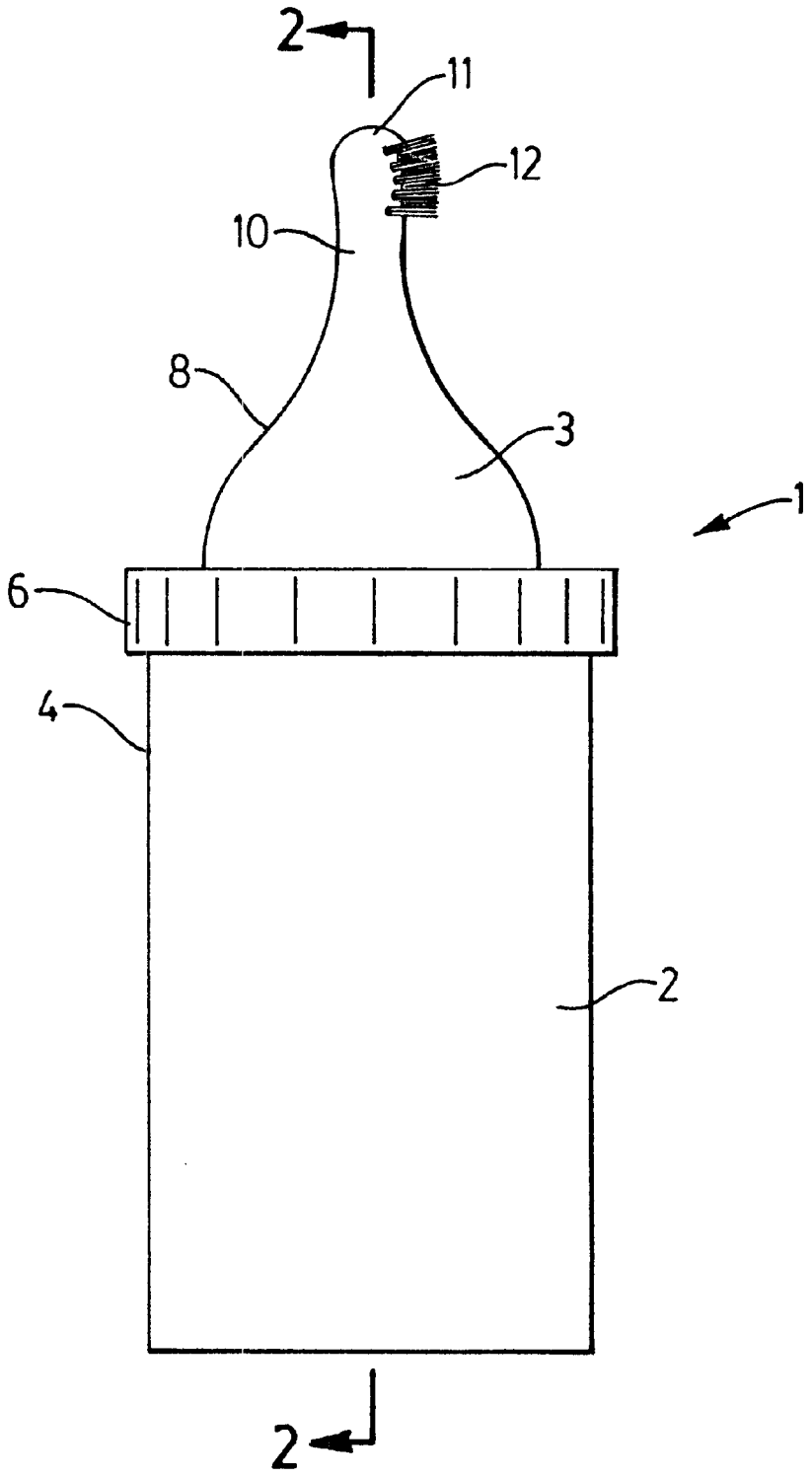
FIG. 1 is a side elevational view of a preferred embodiment of the infant toothbrush according to the present invention.

The present invention may be embodied in a number of different forms. However, the specification and drawings that follow describe and disclose only some of the specific forms of the invention and are not intended to limit the scope of the invention as defined in the claims that follow herein.

The infant toothbrush according to the present invention is identified in the attached drawings generally by reference numeral 1. Infant toothbrush 1 is comprised primarily of a handle 2 and a brush head 3. In the preferred embodiment of the invention handle 2 is a standard baby bottle, which may take the form of any one of a wide variety of commercially available baby bottles. Generally the baby bottle will comprise a cylindrical vessel having an open upper end 4 with exterior threads 5 thereon designed to permit a baby bottle cap or nipple bottle ring 6 to be releaseably secured thereto. Baby bottle caps typically have a centrally positioned opening or hole 7 through their upper surface that permits the cap to be used to secure a nipple over the open upper end of the bottle.

Figure 2:
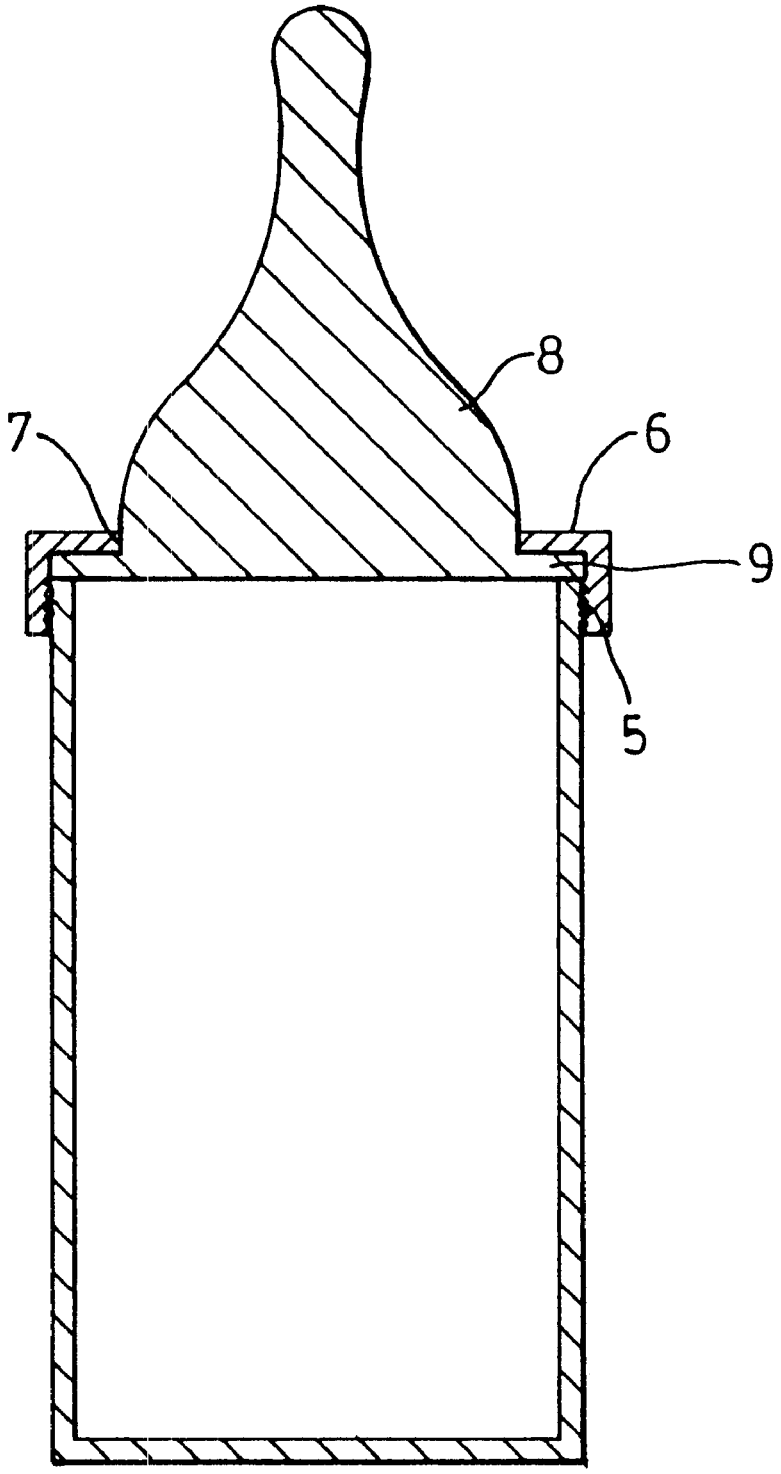
FIG. 2 is a sectional view taken along the line 2—2 of FIG. 1.
Figure 3:
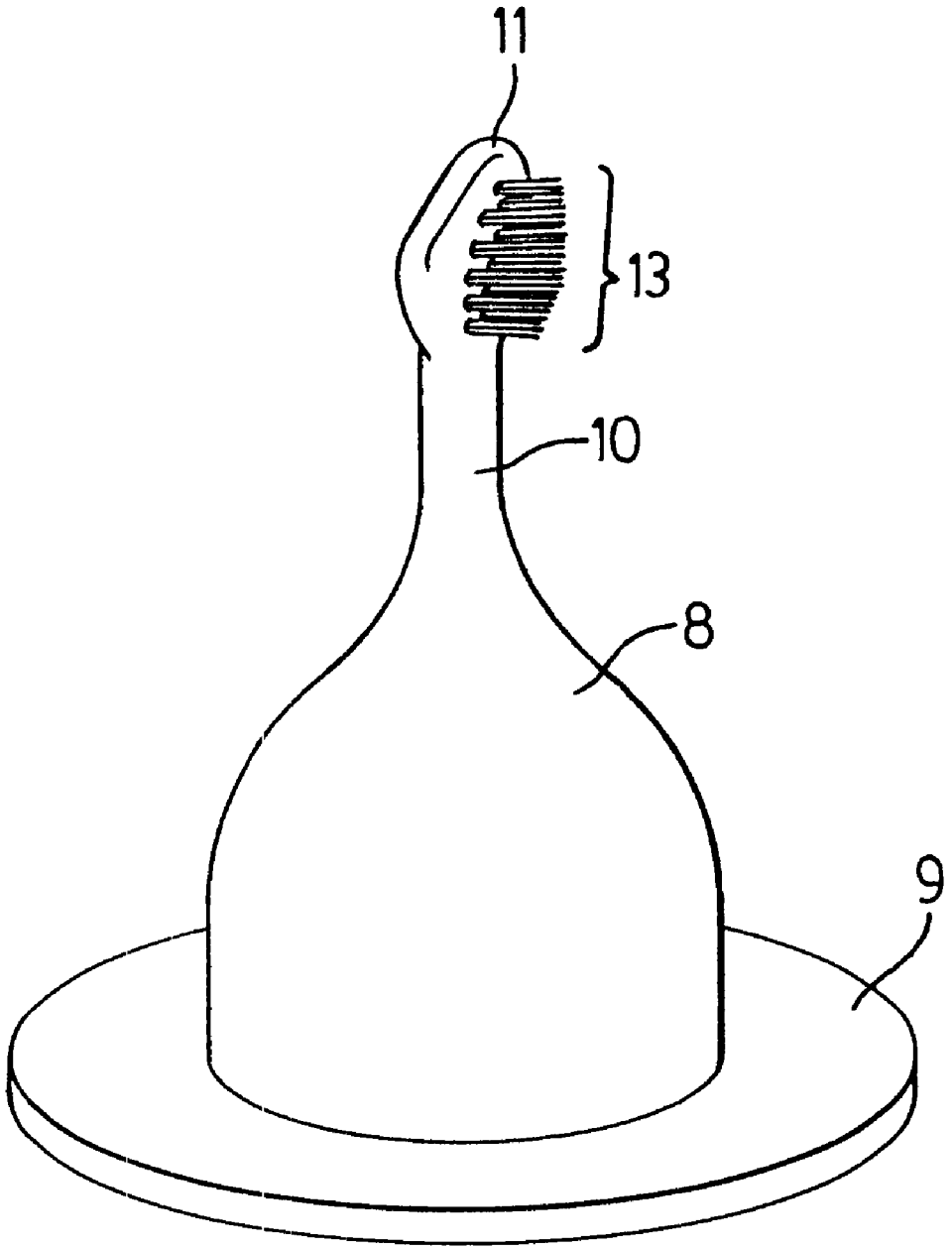
FIG. 3 is an upper side perspective view of the brush head of the infant toothbrush shown in FIG. 1.

Brush head 3 is comprised of a generally conical central body 8 having a lower generally cylindrical base 9 and an upper neck portion 10 that ends in a generally rounded tip 11. In the embodiment of the invention shown in FIGS. 1 through 3, brush head 3 has an overall configuration somewhat similar to that of a standard baby bottle nipple with cylindrical base 9 in the form of a relatively thin outwardly extending radial flange. The flange at the base of the brush head has a small enough diameter such that it may be received within the baby bottle cap, while being too large to fit through opening 7 in the upper surface of the cap. At the same time, central body 8 is configured and dimensioned such that the insertion of brush head 3 into cap 6 allows the central body to extend through opening 7 with lower base or flange 9 retained within the cap, much like a standard nipple is received and secured within a traditional baby bottle cap. In this manner it will be appreciated that the brush head may be releaseably secured to the baby bottle by merely screwing or unscrewing the cap onto the upper end of the bottle. With the brush head secured to the baby bottle, the bottle will serve as a handle allowing for the manipulation of the brush head by infants and small children.

Tip 11 of brush head 3 contains a plurality of protrusions positioned about its surface that provide a brushing or massaging effect when scrubbed across the surface of the teeth or gums. These protrusions may be in the form of small nibs or ridges upon tip 11 or, as in the embodiment shown in the attached drawings, the protrusions may be in the form of bristles 12 that are situated on the tip of the brush head such that they form a generally rectangular shaped brush 13. It will be appreciated from an understanding of the invention that bristles 12 could equally be positioned about the surface of tip 11 in a variety of other geometric patterns. Bristles 12 are preferably elongate, smooth, generally cylindrical members having smooth and generally rounded ends. The bristles may be formed from nylon or a wide variety of other synthetic or natural fibres commonly used in toothbrushes and other oral hygiene appliances. In addition, a number of individual bristles may be packed closely together and arranged in the form of tufts positioned upon the surface of tip 11.

With the exception of bristles 12, in one preferred embodiment brush head 3 is formed from a generally soft, pliable, resilient material, such as rubber, or other similar products that are used in the construction of baby bottle nipples. However, in an alternate embodiment brush head 3 may be constructed from a more rigid material such as those commonly, used in the construction of standard toothbrushes. The surfaces of the brush head will also preferably be smooth and rounded and devoid of sharp corners. The overall length and other dimensional aspects of brush head 3 may be varied while remaining within the broad scope of the invention. For example, the length of neck portion 10 may be relatively short when the toothbrush is to be used by infants having very small mouths. Where toothbrush 1 is to be used by older or larger children, neck portion 10 may be made slightly longer in order to allow easier access to the child's molars and back teeth as they emerge.

Figure 4:
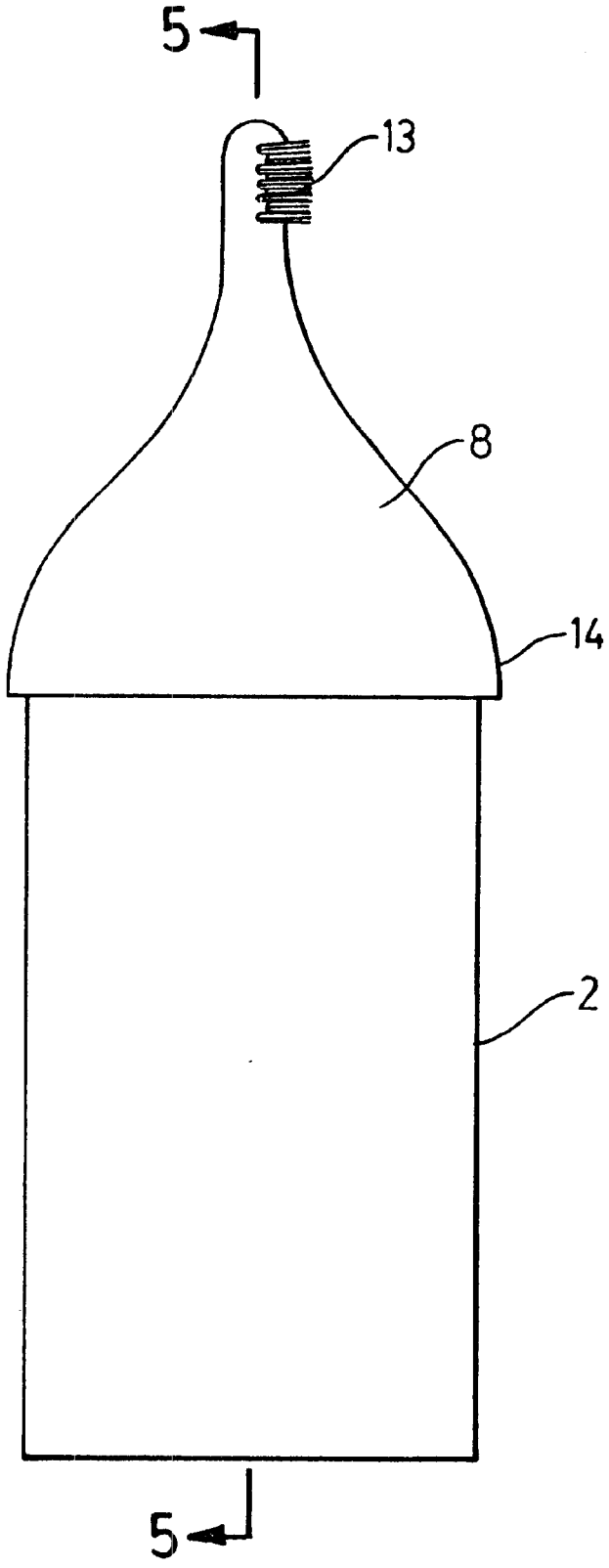
FIG. 4 is a side elevational view of an alternate embodiment of the infant toothbrush according to the present invention; and, FIG. 5 is a sectional view taken along the line of 5—5 of the FIG. 4.
Figure 5:
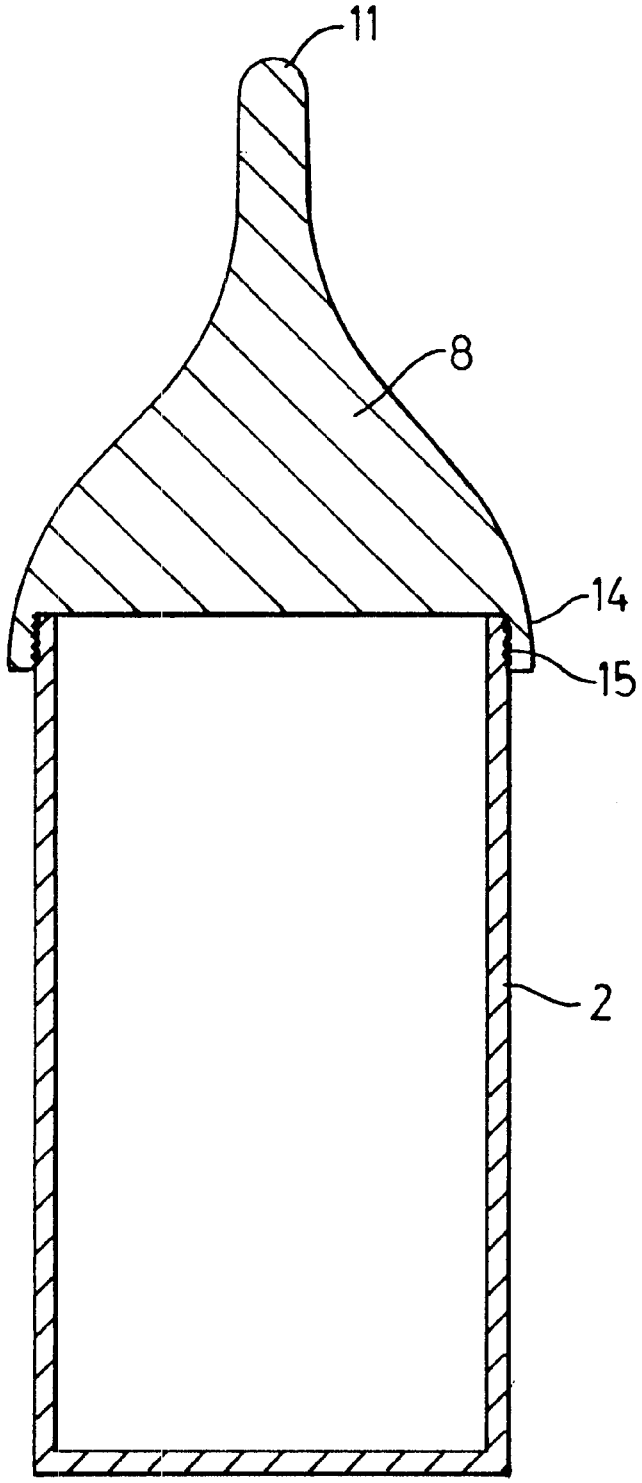

In FIGS. 4 and 5 an alternate embodiment of the present invention is shown. In this embodiment lower base 9 is in the form of a longitudinally oriented hollow cylinder or sleeve 14 that is provided with internal threads 15 upon its lower interior surface. Sleeve 14 is dimensioned such that it may be received over the upper end of the baby bottle with threads 15 engageable with threads 5. That is, in this embodiment the brush head is threaded directly upon the end of the baby bottle without the need for the placement of a radially extending flange between the baby bottle and a threaded cap.

It will thus be appreciated from a thorough understanding of the invention that infant toothbrush 1 will provide a means to massage the gums and gently brush the teeth of infants and small children which is both safe and effective. Unlike standard toothbrushes that have long cylindrical handles, the present invention provides no choking hazards. Through utilizing a baby bottle as its handle, the invention also avoids the possibility that it could be driven into the mouth causing damage to the back of the mouth or throat in the event that a child should fall or be bumped with the brush in his or her mouth. Further, the relatively large diameter of a baby bottle also presents infants and small children with a physical object that is easily handled with only a minimal amount of manual dexterity. By the time that primary teeth begin to emerge in a small child, in most cases the child has become accustomed to sucking and chewing or gnawing upon a baby bottle nipple. With brush head 3 having a general shape resembling a baby bottle nipple, manipulating the brush and chewing upon tip 11 will be a relatively familiar task for a child. Finally, the design of infant toothbrush 1 will also enable small children to utilize the device independently without the need for constant parental intervention or direct supervision.

Further advantages of the present invention lie within the specific design of the brush head. Since brush head 3 is releaseably securable to the baby bottle, should its bristles become worn or damaged the entire brush head can be easily and quickly removed, discarded, and replaced. Just as easily, brush heads having varying bristle designs, or shorter or longer neck portions, can be utilized for children of different ages and different levels of tooth development and/or manual dexterity.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. An infant toothbrush comprising:

(i) a generally cylindrical handle member, said handle member comprising a baby bottle having an upper end and lower end; and, (ii) a brush head releaseably securable to said upper end of said baby bottle, said brush head comprised of a generally conical central body having a lower generally cylindrical base and an upper reduced diameter neck portion ending in a generally rounded tip, said cylindrical base releaseably securable to said baby bottle, said rounded tip having a plurality of protrusions positioned thereon.

2. The device as claimed in claim 1 wherein said upper end of said baby bottle includes threads about its exterior surface, said generally cylindrical base of said brush head threadably receivable over said threads on said upper end of said baby bottle to releasably secure said brush head thereto.

3. The device as claimed in claim 2 wherein said protrusions on said tip of said brush head are bristles.

4. The device as claimed in claim 3 wherein said plurality of bristles positioned on said tip of said brush head are spaced about the circumference of said tip forming a generally cylindrical brush.

5. The device as claimed in claim 3 wherein said plurality of bristles positioned on said tip of said brush head form a generally rectangular shaped brush.

6. The device as claimed in claim 1 wherein said upper end of said baby bottle includes threads about its exterior surface, said infant toothbrush further including a bottle cap threadably engageable with said upper end of said baby bottle, said bottle cap having a generally circular opening therethrough, said generally cylindrical base of said brush head in the form of a relatively thin outwardly extending radial flange dimensioned to be receivable between said bottle cap and said baby bottle with said conical central body extending through said generally circular opening in said bottle cap when said bottle cap is threadably engaged with said upper end of said baby bottle.

7. The device as claimed in claim 6 wherein said protrusions on said tip of said brush head are bristles.

8. The device as claimed in claim 7 wherein said plurality of bristles are positioned about the circumference of said tip of said brush head forming a generally cylindrical brush.

9. The device as claimed in claim 7 wherein said plurality of bristles upon said tip of said brush head are in the form of a generally rectangular shaped brush.

10. An infant toothbrush comprising a handle and a brush head releaseably securable thereto, said handle comprising a baby bottle having a cap threadably receivable upon one end thereof, said cap having a centrally located hole therethrough, said brush head comprised of a generally conical central body having a lower relatively thin radially outward extending flange and an upper neck portion ending in a generally rounded tip having a plurality of protrusions positioned thereon, said radial flange receivable between said baby bottle cap and said baby bottle with said conical central body extending through said hole in said cap when said cap is threadably received upon said bottle.

11. The device as claimed in claim 10 wherein said protrusions on said tip of said brush head are bristles.

12. An infant toothbrush comprising a generally cylindrical handle having opposed first and second ends and a brush head releaseably securable to said first end of said handle, said handle comprising a baby bottle having threads about its exterior surface at said first end, said brush head comprising a generally conical central body having a lower generally hollow cylindrical base portion and an upper neck portion ending in a generally rounded tip having a plurality of protrusions positioned thereon, said cylindrical base portion of said brush head including internal threads engageable with said threads on said exterior surface of said first end of said baby bottle so as to releaseably secure said brush head to said baby bottle.

13. The device as claimed in claim 12 wherein said protrusions on said tip of said brush head are bristles.

* * * * *